United States Patent [19]

Hott et al.

[11] 4,406,216

[45] Sep. 27, 1983

[54] VENTILATOR DEVICE AND MOUNTING ARRANGEMENT THEREFOR

[75] Inventors: William M. Hott, Dayton; John W. Hundley, New Lebanon, both of Ohio

[73] Assignee: Philips Industries, Inc., Dayton, Ohio

[21] Appl. No.: 261,829

[22] Filed: May 8, 1981

[51] Int. Cl.[3] ..... F24F 7/013

[52] U.S. Cl. ..... 98/116; 98/43 R; 98/114; 98/DIG. 8; 248/343; 415/219 R

[58] Field of Search ..... 29/453; 52/27, 39; 98/33 R, 39, 40 D, 40 DL43 R, 114, 116, 119, DIG. 8; 248/343, 342; 415/219 R; 362/147, 404, 365

[56] References Cited

U.S. PATENT DOCUMENTS

| | | | |
|---|---|---|---|
| 1,532,635 | 4/1925 | Osbuh | 98/116 |
| 2,571,726 | 10/1951 | Koch | 98/114 X |
| 2,630,056 | 3/1953 | Glascock | 98/43 |
| 2,661,627 | 12/1953 | Lingelbach | 98/114 |
| 2,739,521 | 3/1956 | Spear | 98/116 |
| 3,169,007 | 2/1965 | Duffy et al. | 248/343 |
| 3,236,171 | 2/1966 | Vaskov et al. | 98/114 |
| 3,270,656 | 9/1966 | Cook | 98/43 |
| 3,327,984 | 6/1967 | Rennie | 248/343 |
| 3,472,150 | 10/1969 | Strawsine | 98/116 |
| 3,760,708 | 9/1973 | Burup | 98/39 |
| 3,985,158 | 10/1976 | Felter | 138/149 |
| 4,122,762 | 10/1978 | Williams | 98/40 |
| 4,171,937 | 10/1979 | Greenfield | 417/424 |
| 4,271,751 | 6/1981 | Timmons | 98/40 D |
| 4,293,895 | 10/1981 | Kristofek | 362/404 X |

FOREIGN PATENT DOCUMENTS

| | | | |
|---|---|---|---|
| 1247761 | 9/1971 | United Kingdom | 98/43 R |

*Primary Examiner*—Albert J. Makay
*Assistant Examiner*—Harold Joyce
*Attorney, Agent, or Firm*—Biebel, French & Nauman

[57] ABSTRACT

A ceiling ventilation device, mountable in an opening in a ceiling between a pair of ceiling joists, includes a pair of mounting brackets. Each bracket, attachable at its ends to a pair of ceiling joists, includes a pair of spring biased mounting tangs spaced along the bracket. A housing defines an air intake opening and an air outlet opening and further defines, on each of two opposing sides thereof, a pair of tang receiving recesses spaced for alignment with and engagement by the tangs. A fan assembly, including a propeller assembly and a motor connected thereto, is mounted in the housing. Once the mounting brackets are connected to ceiling joists and positioned on opposite sides of an opening in a ceiling, the housing may be raised up into the opening such that the recesses in the housing are engaged by the tangs.

23 Claims, 12 Drawing Figures

VENTILATOR DEVICE AND MOUNTING ARRANGEMENT THEREFOR

BACKGROUND OF THE INVENTION

The present invention relates to a ceiling ventilation device and, more particularly, to a ceiling fan unit and a mounting arrangement therefor.

Rising electrical power costs and the resulting increased costs of operating residential air conditioning units have increased the interest in alternative methods of cooling a home. One such method is to provide a ceiling fan unit which draws air into the home through windows and doors and exhausts air from the home interior into the attic, and from the attic to the outside through properly sized vents. Typically, the fan unit is mounted in a central location, suc as a hallway ceiling, so that the cooling effect of the fan unit is distributed evenly through the house. During cooler times of the day and at night, the fan is turned on, drawing the cool outside air into the home. In the morning, the doors, windows, drapes, and shades may be closed to hold in the cool air.

While such ventilation devices, commonly termed whole house ventilators or attic fans, when used either alone or in conjunction with an air conditioning system, can reduce substantially the energy costs associated with cooling a home, installation of such prior art ventilation devices is relatively difficult and expensive, especially in existing homes. To install a prior art ventilation device, a central location is selected for the fan unit and a hole is cut through the plaster or dry wall ceiling. Homes are typically constructed utilizing 2"×6" ceiling joists spaced on 16" centers or triangular roof trusses of 2"×4" or 2"×6" lumber spaced on 24" centers. The lower horizontal portions of the trusses are termed runners or joists and perform essentially the same ceiling support function as the joists in a joist construction home. Hereafter, the parallel horizontal wooden support members directly above the dry wall or plaster ceiling will be referred to as "joists", with it being understood that this term applies to such members used in both joist and truss construction.

Depending upon the size of the fan unit to be installed, it may be necessary to cut one of the joists to provide an opening in the ceiling sufficient in size to receive the fan unit. If a 22"×22" fan unit is to be installed in the ceiling of a home having joists on 24" centers, it is not necessary to cut any of the joists. If, on the other hand, a 22"×22" fan unit is to be installed in the ceiling of a home having joists on 16" centers or a 30"×30" fan unit is to be installed in the ceiling of a home having joists on 16" or 24" centers, one of the joists must be cut.

After cutting an opening in the dry wall or plaster of appropriate size to receive a shutter assembly or intake grill, and cutting a ceiling joists, if necessary, the ceiling opening is then framed in with lumber of the same size as the joists to provide a frame in which the shutter assembly is mounted. An additional frame is constructed for mounting the fan unit above the shutter assembly. Wiring must then be provided to power the electric motor of the fan unit and, typically, wires must be fished down into a wall close to the fan unit and connected to wall mounted control switches. Although wiring a prior art ceiling fan unit is not as difficult when the unit is installed at the time that the home is under construction, nevertheless, a support frame must be constructed to mount the shutter assembly and fan unit in the ceiling.

An additional problem exists with respect to prior art ceiling fan units. Typically, the attic of a home is insulated with fiber glass or cellulose insulation, with the insulating material being placed between the joists on top of the dry wall or plaster ceiling. In view of the fact that the fan unit exhausts air into the attic, it is not possible to cover the fan unit with such an insulation. As a consequence, the homeowner must manually cover the fan unit with insulation material over the shutter assembly or in the attic each fall and remove the insulation material each spring prior to use of the fan. This is inconvenient.

Accordingly, there is a need for a ceiling ventilation device which is simple in construction, which is easily mounted in a ceiling opening, and in which thermal insulation and sealing are provided to prevent heat loss and drafts through the device during periods in which the device is not in operation.

SUMMARY OF THE INVENTION

A ceiling ventilation device according to the present invention, which overcomes the problems pointed one above with respect to prior art ceiling fan units, is mountable in an opening in a ceiling between a pair of ceiling joists. The device includes a pair of mounting brackets, each such bracket including means at each end thereof for attachment to a ceiling joist and further including a pair of spring biased mounting tangs spaced along the bracket. A housing defines an air intake opening and an air outlet opening and further defines on each of two opposing sides thereof, a pair of tang receiving recesses spaced for alignment with and engagement by the tangs. A fan assembly, including a propeller assembly and a motor connected thereto, is mounted in the housing.

The mounting brackets may be extensible so as to provide for attachment to ceiling joists of various spacings. Each of the brackets may define holes intermediate its ends for attachment to a ceiling joists.

The device may further include a plurality of shutters pivotally mounted to the housing and extending across the air intake opening. Each of the shutters is movable between a first position in which the intake opening is closed and a second position in which the intake opening is open to permit air to be drawn into the housing. A connector rod connects the shutters to provide simultaneous movement of the shutters between their first and second positions. A spring means is attached to the connector rod for providing a spring biasing force tending to move the shutters into their second positions, whereby the air velocity through the intake opening required to maintain the shutters in their second positions is reduced. A flange surrounds the air intake opening and limits the downward movement of the shutters into their first positions. The shutters may be made of a polystyrene material.

The housing may define an outwardly extending flange surrounding the intake opening. The flange covers the edge of the ceiling opening in which the device is mounted. The housing may be formed of a glass filled polyester material.

Each of the brackets may comprise a first bracket plate defining the tangs and a second bracket plate slidably engaging the first bracket plate to effect extension of the bracket for attachment at its ends to a pair of ceiling joists. The first bracket plate may define a flange for contacting the ceiling adjacent the ceiling opening, thereby facilitating positioning of the brackets.

The device may further include a damper means mounted on the housing for closure of the air outlet opening when the fan assembly is not in operation. The damper means may include a pair of damper plates mounted to pivot upward about a common axis extending across the air outlet opening. The damper plates may be formed of a material sufficiently light such that air movement through the ventilation device pivots the plates upward from closed positions in which the outlet opening is covered to open positions. The damper plates may be formed of expanded polystyrene to provide thermal insulation. The damper means may further include stop means for preventing the damper plates from pivoting beyond the open positions into vertical positions. The housing may include a pair of metal portions adjacent the outlet opening. Each of the damper plates may include a magnet mounted thereon for magnetic engagement with a respective one of the metal portions, thereby holding the damper closed during periods in which the device is not in operation.

The damper means may include a pair of damper plates mounted on the housing to pivot between closed positions, covering the air outlet opening, and open positions. A linkage means, including a manually actuatable control rod, may be provided for moving the damper plates between their closed and open positions.

The device may further include a cross bracket and means for connecting the cross bracket to the mounting brackets to extend substantially perpendicular therebetween.

Each of the mounting brackets may include a pair of adjustable latching brackets, with each such latching bracket defining one of the spring biased mounting tangs. Each of the adjustable latching brackets may also define a flange for contacting the ceiling adjacent the opening in the ceiling, thereby facilitating positioning of the adjustable latching brackets. The housing may define openings in each of the tang receiving recesses to facilitate disengagement of the tangs from the recesses and to provide for securing the tangs to the housing by screws or other means, if desired.

The housing may further define a power opening. The device may further include an electrical junction box mounted on one of the mounting brackets adjacent the power opening, and electrical conductor means extending through the power opening and provide an electrical connection between the junction box and the motor. The housing may further define an inwardly extending flange surrounding the power opening, and power opening cover means for covering the power opening. The electrical outlet receptacle and the electrical conductor means may include a mating electrical connector.

Accordingly, it is an object of the present invention to provide a ceiling ventilation device which is simple in construction and which may be mounted in an opening in a ceiling between a pair of ceiling joists without the need for construction of a support frame; to provide such a device wherein a pair of mounting brackets are provided for attachment to the ceiling joists and wherein each of the mounting brackets defines spring biased mounting tangs which engage recesses defined in a housing; to provide such a device wherein the mounting brackets are extensible for attachment to ceiling joists of various spacings; to provide such a device wherein a damper means is mounted on the housing for closure of the air outlet opening; to provide such a device wherein the damper means includes a pair of damper plates which are sufficiently light such that air movement through the device pivots the plates upward to open positions; to provide such a device wherein a magnetic latch arrangement securely closes the damper plates; to provide such a device wherein the damper plates are moved by a manually actuatable control rod between their closed and open positions; and, to provide such a device wherein a cross bracket extends between the mounting brackets so as to define the opening in which the ventilation device is to be mounted.

Other objects and advantages of the invention will be apparent from the following description, the accompanying drawings and the appended claims.

DETAILED DESCRIPTION OF THE PREFERRED EMBODIMENTS

Figure 1:
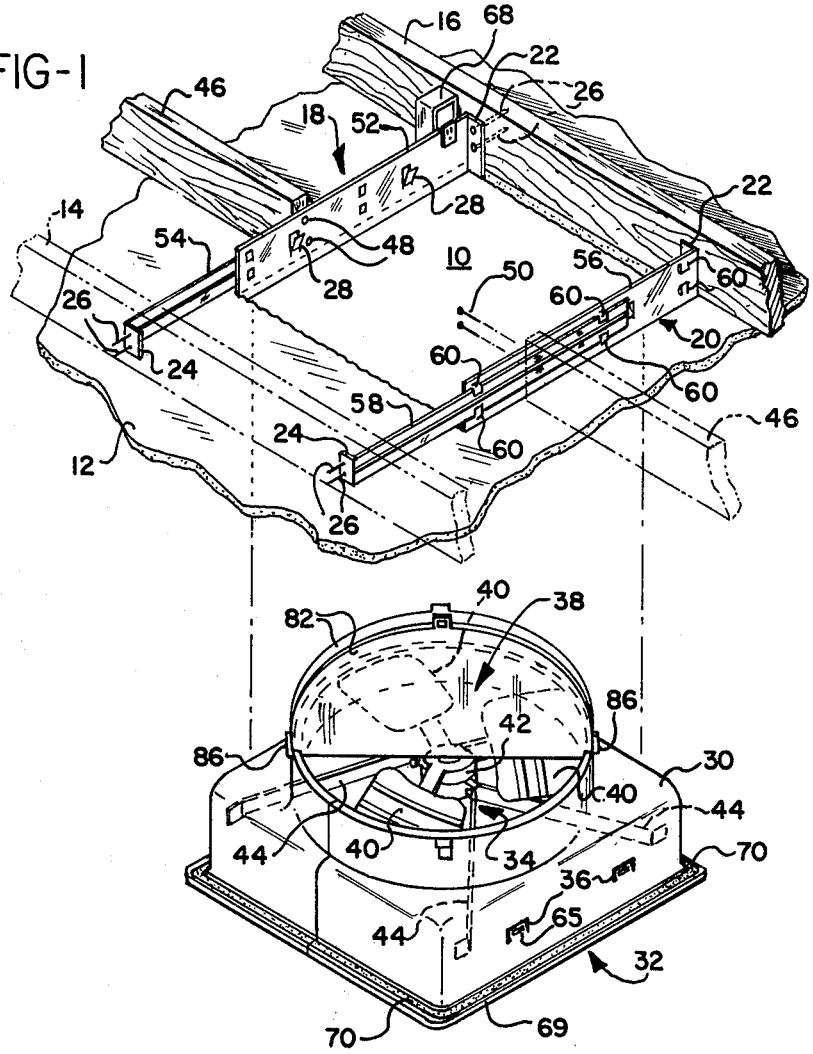
FIG. 1 is an exploded perspective view of a ceiling ventilation device constructed according to the present invention, illustrating the manner in which it is mounted to a pair of ceiling joists.

FIGS. 1-5 illustrate a ceiling ventilation device according to the present invention which is mountable in an opening 10 in a ceiling 12, between a pair of ceiling joists 14 and 16. The ventilation device includes a pair of mounting brackets 18 and 20. Each such bracket includes means at each end thereof for attachment to the ceiling joists. Thus, bracket portions 22 and 24 define holes for attachment to the joists 14 and 16 with nails 26 or other suitable fastening devices. Brackets 18 and 20 each further includes a pair of spring biased mounting tangs 28 which are spaced along the bracket.

A housing 30, which may preferably be formed of a glass filled polyester material, defines an air intake opening 32 and an air outlet opening 34. The housing further defines a pair of tang receiving recesses 36, on each of two opposing sides thereof, spaced for alignment with and engagement by the tangs 28. A fan assembly 38, including a propeller assembly 40 and a motor 42, is mounted to the housing 30 by mounting struts 44 attached to the motor 42.

Mounting brackets 18 and 20 may be extended for attachment to ceiling joists of various spacings. The ventilation device may therefore be mounted between joists on either 16" or 24" centers. Shown in FIG. 1 is a ventilation device having a 22"×22" housing which is to be mounted in a ceiling in which the joists are spaced apart on 16" centers. As a consequence, it is necessary to cut joist 46, as shown, to provide an opening 10, slightly larger than 22"×22", for insertion of the ventilation device. Holes 48 are provided in the brackets 18 and 20 for attachment of the brackets to the ends of the joist 46 by nails 50. Similar holes are provided in the brackets utilized with a 30"×30" ceiling ventilation device for attachment to the ends of the joist which must be cut when mounting the device in the ceiling of a home having joists spaced on either 16" or 24" centers.

Figure 2:
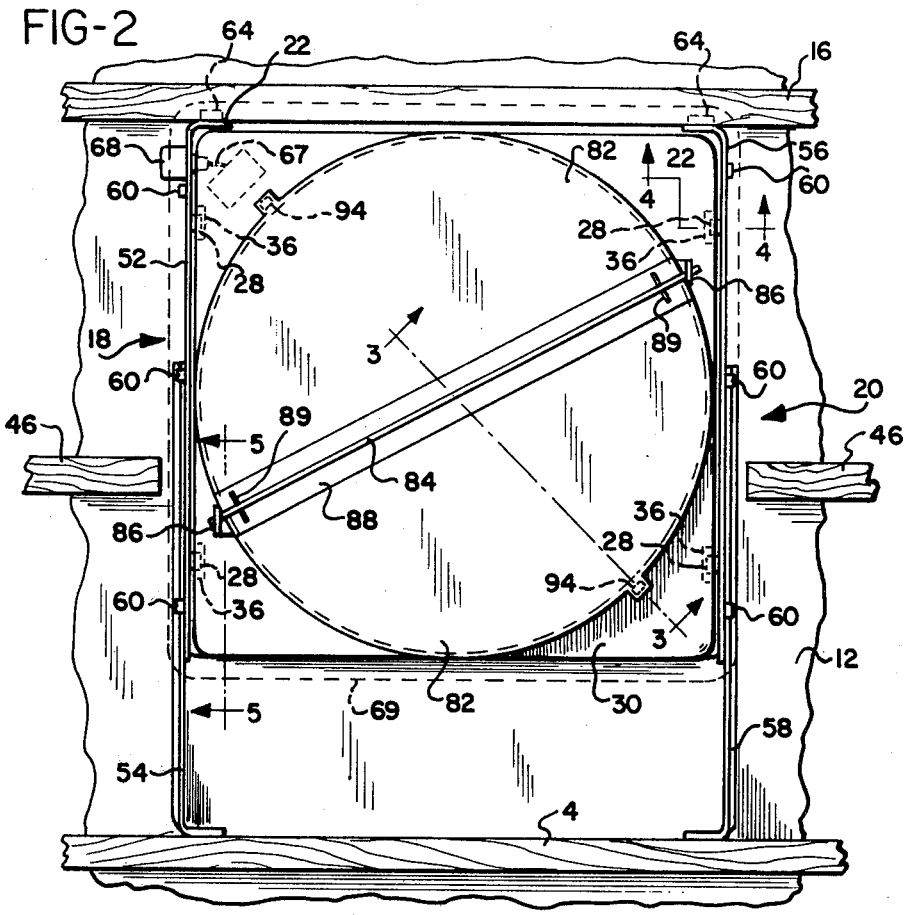
FIG. 2 is a plan view of the device of FIG. 1.
Figure 4:
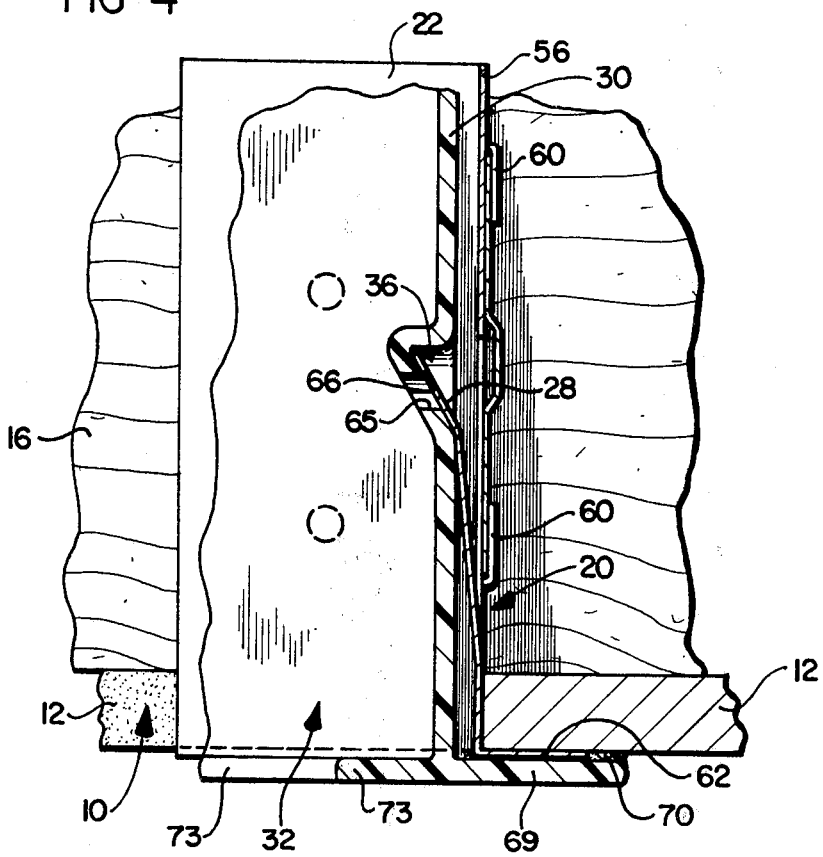
FIG. 4 is a sectional view, taken generally along line 4—4 in FIG. 2.

Bracket 18 comprises a first bracket plate 52 defining the tangs 28 and a second bracket plate 54 slidably engaging plate 52. Similarly, bracket 20 includes a first bracket plate 56 defining a pair of tangs 28 and a second bracket plate 58 which slidably engages plate 56. As best seen in FIG. 4, plates 52 and 56 define a plurality of tabs 60 which may be punched from the material forming the plates 52 and 56, and which engage the second bracket plates 54 and 58. The first bracket plates 52 and 56 further define flanges 62 which contact the bottom of ceiling 12, adjacent the opening 10, thus assuring that the brackets are positioned at the proper height within the opening 10. As shown in FIG. 2, end portions 22 may also define flanges 64 for the same purpose.

Installation of the ceiling ventilation device of the present invention in the ceiling of an existing home is relatively simple as compared with prior art installation methods. A location for the ventilation device is selected, such as in a hallway of the home, and an opening 10 of appropriate size to receive the housing 30 is cut through the plaster or wall board ceiling. If necessary, a joist 46 is also cut, as shown in FIG. 1.

Brackets 18 and 20 are then positioned on opposite sides of the opening 10 with flanges 62 and 64 in contact with the ceiling 12 adjacent the opening 10. Plates 54 and 58 are extended as required, and the ends of the brackets 18 and 20 are attached to the joists 14 and 16. The housing 30 is then raised from below, into the opening 10 in the ceiling. When the housing 30 has been raised completely into position, the tangs 28 snap into the mating recesses 36, as shown in FIG. 4, providing a secure, positive engagement of and support for the housing 30.

If desired, screws may be inserted through slots 65 to engage holes 66 in tangs 28. Should it ever be necessary to remove housing 30 from opening 10, a screwdriver or similar tool may be inserted into slots 65 to press tangs 28 out of recess 36. Installation of the device is completed by plugging the motor power circuit conductor 67 into an electrical junction box 68, which may advantageously be mounted directly on bracket 18, and which is connected to the home electrical system.

Figure 5:
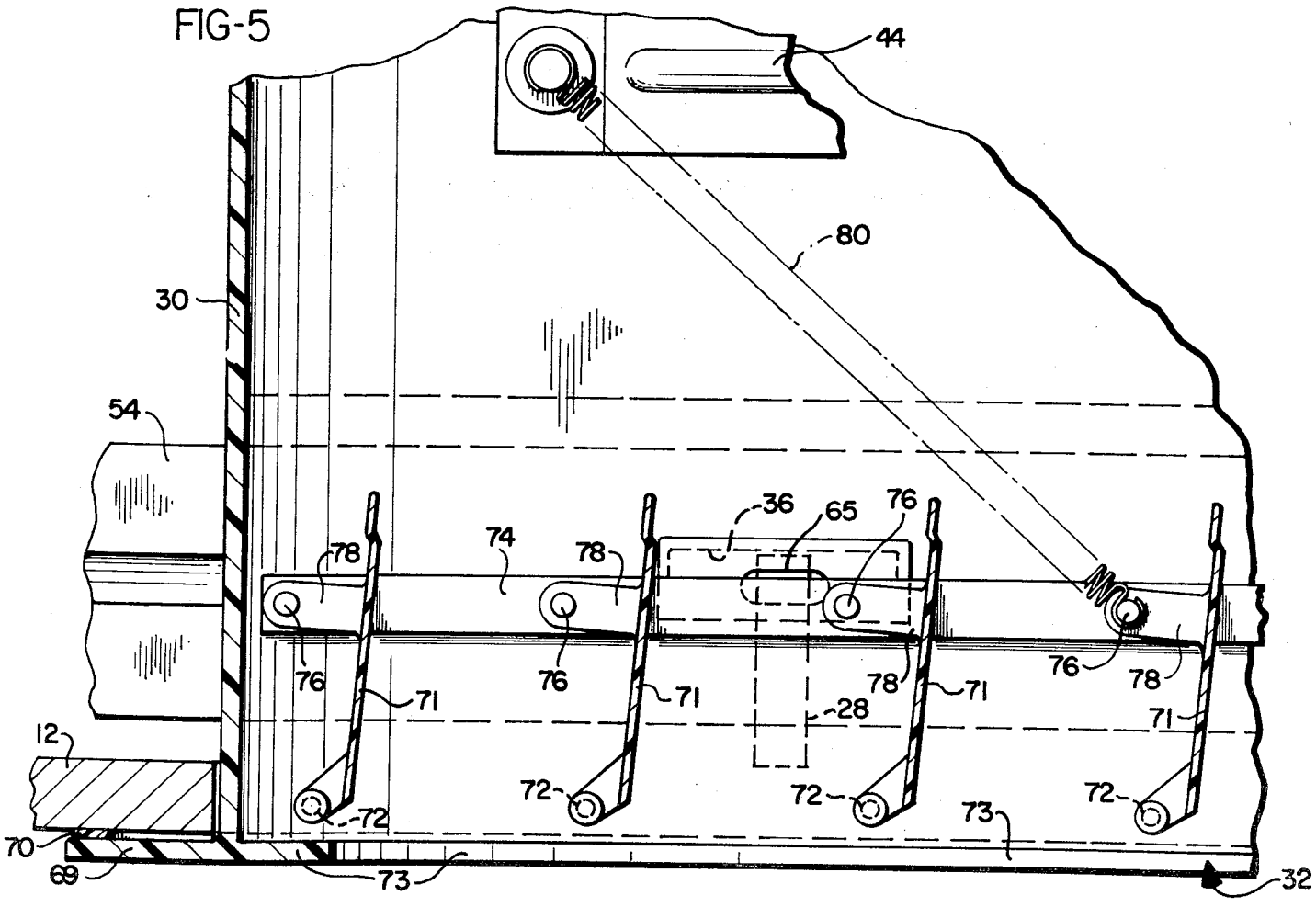
FIG. 5 is a sectional view, taken generally along line 5—5 in FIG. 2.

Housing 30 further includes an outwardly extending flange 69 which surrounds the intake opening 32. As shown in FIGS. 4 and 5, flange 69 covers the edge of opening 10 in the ceiling and provides a finished appearance. Additionally, a foam strip 70 is provided on the upper edge of flange 69 and is compressed between the ceiling 12 and flange 69 so as to seal the edge of opening 10.

As shown in FIG. 5, the ventilation device further includes a plurality of shutters 71 which are pivotally mounted to housing 30 and which extend across air intake opening 32. The shutters 71 include mounting pegs 72 at each end thereof which are received into corresponding openings in housing 30. Each of the shutters 71 is movable between a first position, in which it is generally horizontal and overlaps adjacent shutters and an inwardly extending flange 73 which encircles opening 32 so as to close the intake opening 32, and a second position, illustrated in FIG. 5, in which the intake opening 32 is open to permit air to be drawn into the housing 30. A connector rod 74 connects the shutters 71 to provide simultaneous movement of the shutters between their first and second positions. Rod 74 includes a plurality of pegs 76, spaced along its length, which extend into openings in tabs 78 formed at one end of each of the shutters 71.

Pegs 76 fit loosely within the openings in tabs 78 and ensure that the shutters pivot together between their first and second positions. The shutters are preferably formed of a relatively light plastic material, such as polystyrene, such that the air flow produced by rotation of the propeller assembly draws the shutters upward into their open positions. To assist in the upward movement of the shutters 71, a spring means, including tension spring 80, is attached to the connector rod 74 and provides an upward spring biasing force. As a consequence, the air velocity through the intake opening 32 which is required to maintain the shutters in their open positions is substantially reduced. When in their respective first positions, the ends of shutters 71 rest on the top of flange 73 which therefore limits their downward movement.

The ventilation device of the present invention further comprises a damper means including a pair of damper plates 82, which are mounted on housing 30 to close the air outlet opening 34 when the fan assembly 38 is not in operation. In a first embodiment, shown in FIGS. 1–3, the damper plates are mounted to pivot upward about a shaft 84. Shaft 84 is journaled in support brackets 86 attached on opposite sides of the housing 30. Plates 82 are attached together by means of a strip of adhesive backed tape 88 which flexes to permit upward movement of the damper plates 82. Plates 82 are formed of a material, such as expanded polystyrene, which is sufficiently light such that air movement through the housing 30 pivots the plates upward to their open positions. Expanded polystyrene additionally provides thermal insulation when the plates are closed so as to prevent heat loss through the ventilation device during the winter.

A stop means, including wire strips 89, is provided to prevent the damper plates 82 from pivoting beyond their normal open positions into completely vertical positions. This ensures that during operation of the ventilation device, the plates 82 are held at a slight angle to vertical and upon termination of operation of the device, the weight of the plates 82 will cause them to fall downward into their closed positions. To ensure that a tight seal between the plates 82 and housing 30 is provided, a pair of metal brackets 90 are mounted on housing 30 by bolts 92 and are engaged by permanent magnets 94 on the plates 82. A strip of rubber 96 is mounted on the housing and is compressed between plates 82 and housing 30 when the damper arrangement is closed so as to seal the housing securely.

Figure 6:
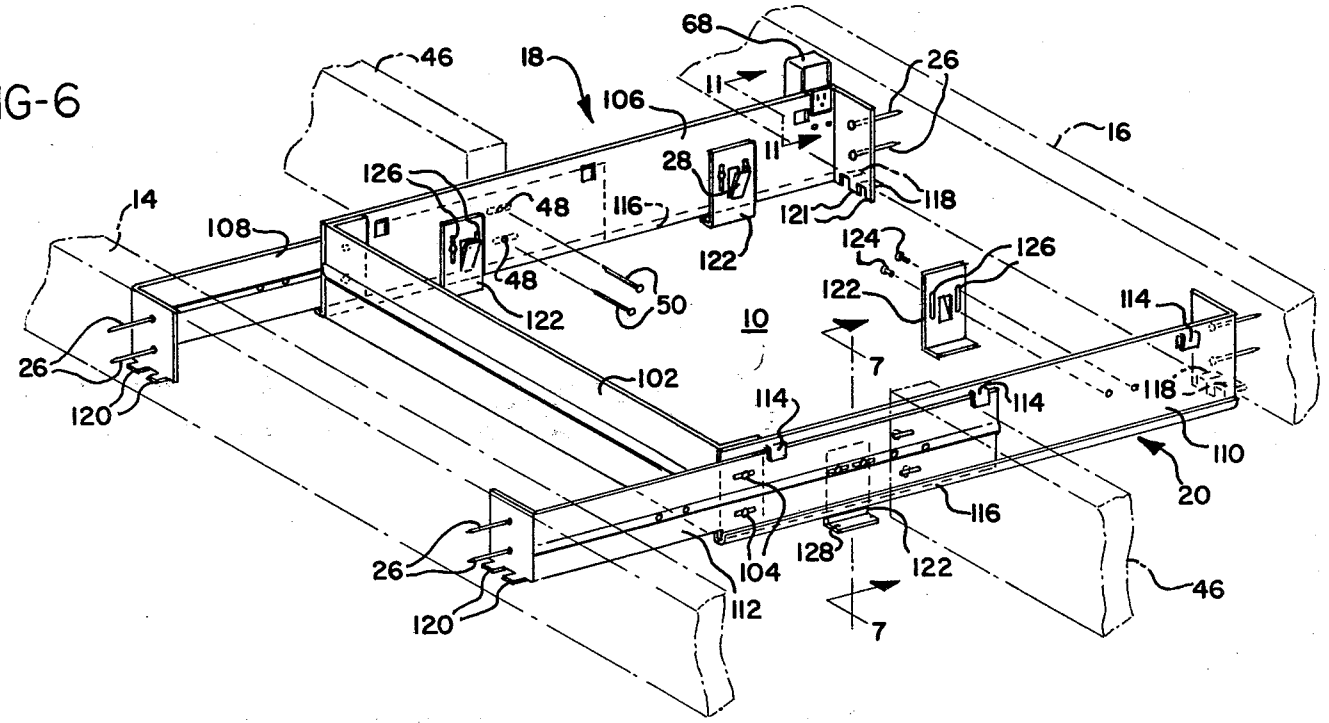
FIG. 6 is a perspective view illustrating an alternative mounting arrangement for the ventilation device of the present invention.
Figure 7:
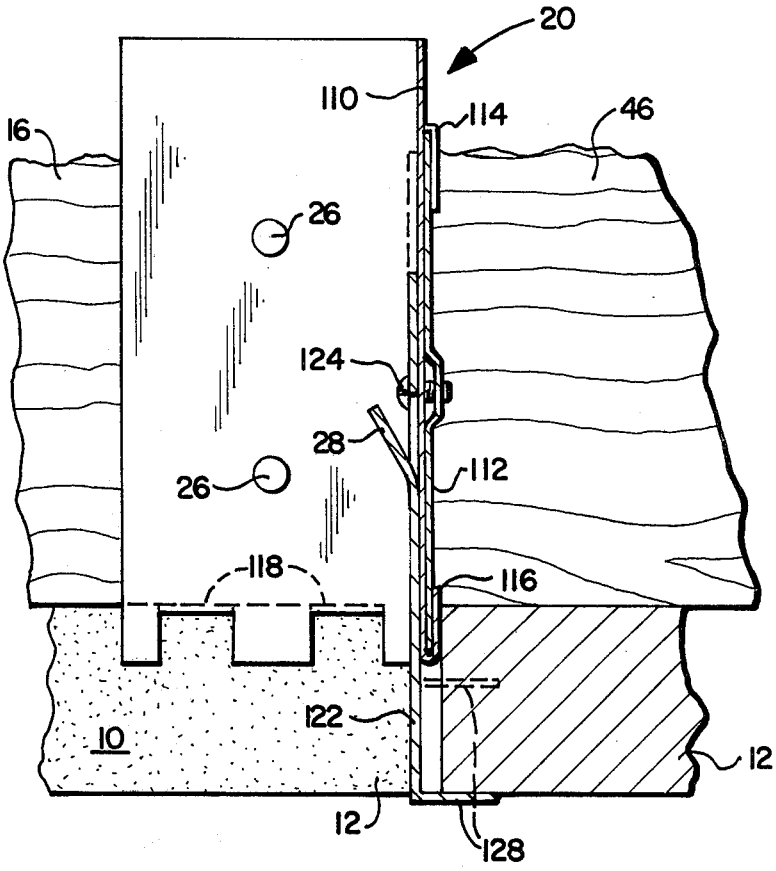
FIG. 7 is an enlarged sectional view, taken generally along line 7—7 in FIG. 6.
Figure 8:
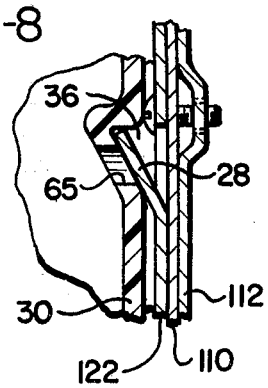
FIG. 8 is an enlarged sectional view, similar to FIG. 7, illustrating the manner in which the housing of the ventilation device is engaged by a mounting bracket.

FIGS. 6–8 illustrate an alternative mounting bracket arrangement which is particularly adapted for installation of a ceiling ventilation device at the time that a home is constructed. The mounting arrangement is similar in certain respects to that shown in FIGS. 1–5, and the same reference numerals have been utilized to indicate corresponding structural elements. Mounting brackets 18 and 20 are provided for attachment to ceiling joists 14 and 16, typically prior to installation of the dry wall ceiling. These brackets may also be attached by nails 50 to a joist 46. A cross bracket 102 is attached to mounting brackets 18 and 20 by screws 104 so as to provide a guide for a worker installing the dry wall as to the size and position of the opening 10.

Bracket 18 includes a first bracket plate 106, and a second bracket plate 108 which is slidably engaged by plate 106. Similarly, bracket 20 includes a first bracket plate 110, and a second bracket plate 112 slidably engaged by plate 110. Tabs 114 are punched from plate 110 and engage the upper edge of plate 112. The lower edge of plate 110 is bent upward into a lip 116 which engages the lower edge of plate 112. The ends of brackets 18 and 20 define flanges 118 and 120 which, when the brackets are attached to the ceiling joists, contact the bottom surfaces of the joists. This ensures that the brackets 18 and 20 are properly positioned slightly below the joists and vertically oriented such that bracket portions 121, lips 116 and cross bracket 102 define the opening 10 and facilitate installation of dry wall.

After the dry wall material 12 is attached to the joists, a pair of adjustable latching brackets 122 is attached to each of plates 106 and 110 by means of screws 124. Screws 124 extend through slots 126 in brackets 122 and thus permit the brackets 122 to be adjusted vertically. The range of vertical movement of brackets 122 is illustrated in FIG. 7. Brackets 122 are positioned with the lower flange portions 128 of the brackets contacting the lower surface of ceiling 12, regardless of the thickness of the dry wall material which has been installed. Each of the adjustable latching brackets 122 defines a spring biased mounting tang 28 which, as illustrated in FIG. 8, engages recess 36 in housing 30 when the housing is raised from below into the opening 10.

Figure 9:
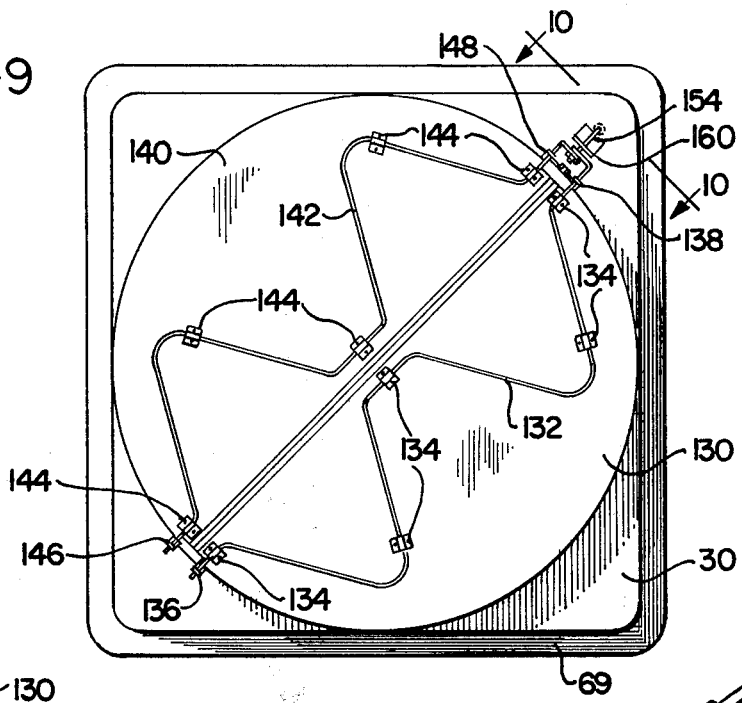
FIG. 9 is a plan view of the ventilation device housing, illustrating an alternative damper arrangement.
Figure 10A:
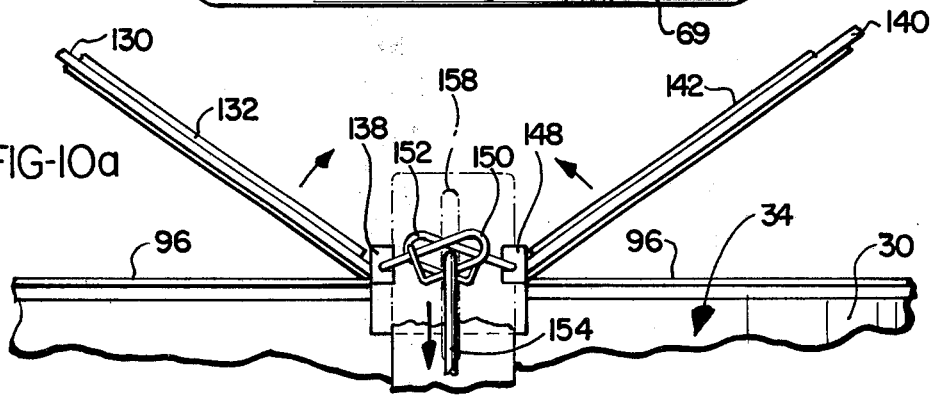
FIGS. 10A and 10B are elevational views taken generally along line 10—10 in FIG. 9, illustrating operation of the damper arrangement of FIG. 9.
Figure 10B:
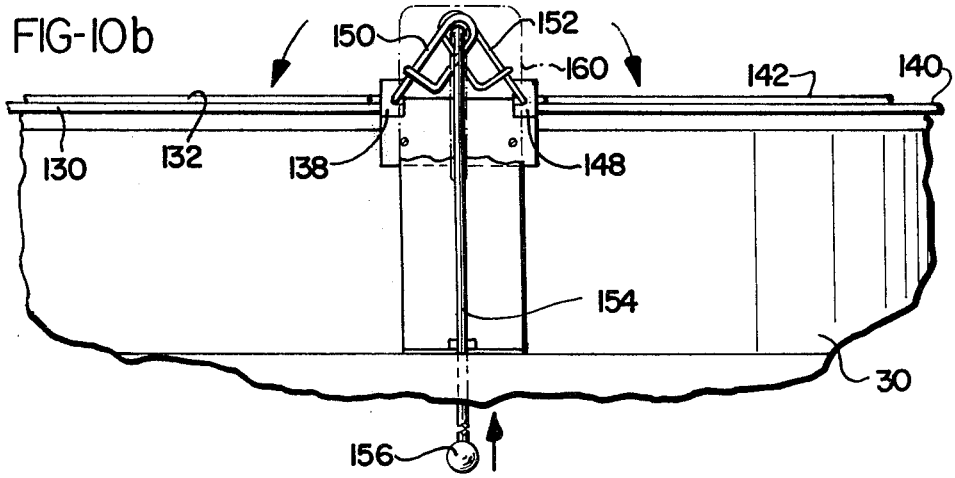

Reference is now made to FIGS. 9, 10A and 10B, which illustrate an alternative damper arrangement for covering air outlet opening 34. Damper plate 130 has a linkage wire 132 attached to its upper surface by brackets 134. Wire 132 is received in an opening in a bracket 136 and extends through an opening in bracket 138 such that plate 130 may be pivoted upward. Similarly, damper plate 140 has a linkage wire 142 attached to its upper surface by fasteners 144. Wire 142 extends through openings in brackets 146 and 148, thus providing plate 140 with a mounting arrangement which permits it to pivot upward.

The ends of wires 132 and 142 are formed into a pair of loops 150 and 152, respectively, which engage the end of a manually actuatable control rod 154. Rod 154 has a handle mounted on its lower end, permitting it to be raised and lowered. Rod 154 extends upward through housing 30, and its upper end passes through a guide slot 158 defined by bracket 160 which, for the sake of clarity, is illustrated in dashed lines in FIGS. 10A and 10B. Upward movement of rod 154 results in the damper plates being closed, as shown in FIG. 10B, while downward movement of control rod 154 pivots the damper plates 130 and 140 upward into open positions. Sufficient downward movement of control rod 154 causes the damper plates 130 and 140 to pivot over center, thus holding them in their open positions until control rod 154 is manually moved upward.

Figure 3:
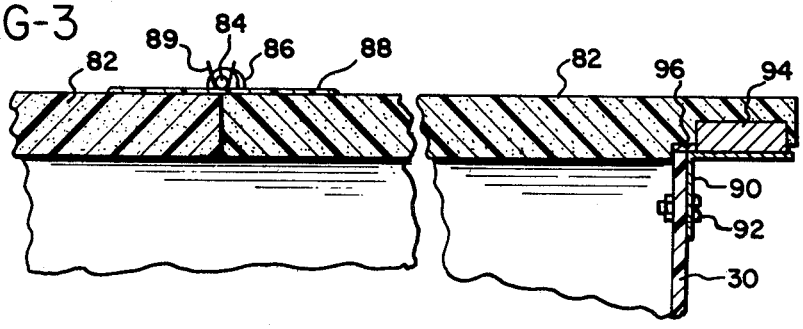
FIG. 3 is a sectional view, taken generally along line 3—3 in FIG. 2.

It will be appreciated that a damper arrangement as shown in FIGS. 9 and 10 may be utilized in a housing mounted by mounting brackets as shown in FIG. 1 and, further, that a damper arrangement as depicted in FIGS. 2 and 3 may be utilized with a housing mounted by brackets as illustrated in FIGS. 6–8.

Figure 11:
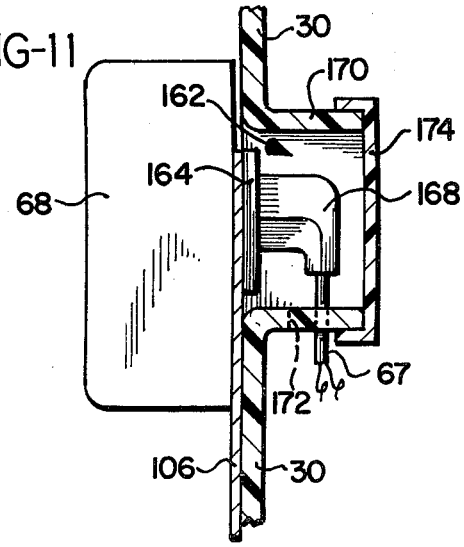
FIG. 11 is an enlarged sectional view taken generally along line 11—11 in FIG. 6 and including the housing.

FIG. 11 illustrates the manner in which electrical power is provided for the electrical motor power circuit. Housing 30 defines a power opening 162 which is adjacent to the electrical junction box 68 mounted on bracket plate 106. The junction box 68 includes an electrical outlet receptacle 164 of conventional design into which a mating electrical connector 168 is plugged. This arrangement facilitates installation of the ventilation device and, further, provides a simple means of disconnecting the motor power circuit should the ventilation device need to be removed for servicing or for other reasons.

The housing 30 further includes an inwardly extending flange 170 surrounding the opening 162. Flange 170 defines a notch 172 which permits conductor 67 to pass therethrough. A cap 174, or other power opening cover means such as an adhesive backed tape, may be attached to the flange 170 so as to close the opening 162 and reduce heat loss through the opening.

While the forms of apparatus herein described constitute preferred embodiments of the invention, it is to be understood that the invention is not limited to these precise forms of apparatus, and that changes may be made therein without departing from the scope of the invention.

What is claimed is:

1. A ceiling ventilation device, mountable in an opening in a ceiling between a pair of ceiling joists, comprising:

a pair of mounting brackets, each such bracket including means at each end thereof for attachment to a ceiling joist, and further including a pair of spring biased upwardly extending mounting tangs spaced along said bracket, a housing defining an air intake opening and an air outlet opening and further defining, on each of two opposing sides thereof, a pair of downwardly facing tang receiving recesses spaced for alighment with and engagement by said tangs, in response to the upward movement of said housing into the space between said brackets such that the upper ends of said tangs engage the interior surfaces of said recesses aligned therewith, and a fan assembly, including a propeller assembly and a motor connected thereto, mounted in said housing.

2. The device of claim 1 in which said mounting brackets are extensible so as to provide for attachment to ceiling joists of various spacings.

3. The device of claim 1 in which each of said brackets defines holes intermediate its ends for attachment to a ceiling joist.

4. The device of claim 1 further comprising a plurality of shutters pivotally mounted to said housing and extending across said air intake opening, each of said shutters being movable between a first position, in which said intake opening is closed, and a second position, in which said intake opening is open to permit air to be drawn into said housing, a connector rod connecting said shutters to provide simultaneous movement of said shutters between their first and second positions, and spring means, attached to said connector rod, for providing a spring biasing force tending to move said shutters into their second positions, whereby the air velocity through said intake opening required to maintain said shutters in their second positions is reduced.

5. The device of claim 4 in which said shutters are made of a polystyrene material.

6. The device of claim 1 in which said housing defines an outwardly extending flange surrounding said intake opening, whereby said flange covers the edge of said opening in a ceiling in which said device is mounted.

7. The device of claim 2 in which each of said brackets comprises a first bracket plate defining said tangs and a second bracket plate slidably engaged by said first bracket plate to promote extension of said bracket for attachment at its ends to a pair of ceiling joists.

8. The device of claim 7 in which said first bracket plate defines a flange for contacting the ceiling adjacent said opening in the ceiling, whereby positioning of each of said brackets is facilitated.

9. The device of claim 1 in which said housing is formed of a glass filled polyester material.

10. The device of claim 1 further comprising a damper means, mounted on said housing, for closure of said air outlet opening when said fan assembly is not in operation.

11. The device of claim 10 in which said damper means comprises a pair of damper plates mounted to pivot upward about a common axis extending across said air outlet opening, said damper plates being formed of a material sufficiently light such that air movement through said ventilation device pivots said plates upward from closed positions, in which said outlet opening is covered, to open positions.

12. The device of claim 11 in which said damper plates are formed of expanded polystyrene to provide thermal insulation.

13. The device of claim 11 in which said damper means further comprises stop means for preventing said damper plates from pivoting beyond said open positions into vertical positions.

14. The device of claim 11 in which said housing comprises a pair of metal portions adjacent said outlet opening and in which each of said damper plates includes a magnet mounted thereon for magnetic engagement with a respective one of said metal portions, whereby said damper is held closed during periods in which said device is not operated.

15. The device of claim 10 in which said damper means comprises a pair of damper plates mounted on said housing to pivot between closed positions, covering said air outlet opening, and open positions, and linkage means, including a manually actuatable control rod, for moving said damper plates between their closed and open positions.

16. The device of claim 1 in which said device further comprises a cross bracket, and means for connecting said cross bracket to said mounting brackets to extend between said mounting brackets substantially perpendicular thereto.

17. The device of claim 1 in which each of said mounting brackets includes a pair of adjustable latching brackets, each such latching bracket defining one of said spring biased mounting tangs.

18. The device of claim 17 in which each of said adjustable latching brackets defines a flange for contacting the ceiling adjacent said opening in the ceiling to facilitate positioning each of said adjustable latching brackets.

19. The device of claim 1 in which said housing defines openings in each of said tang receiving recesses to facilitate disengagement of said tangs from said recess.

20. The device of claim 19 further comprising means extending through said openings in said tang receiving recesses to secure said housing to said tangs.

21. The device of claim 1 in which said housing further defines a power opening, and in which said device further includes an electrical junction box mounted on one of said mounting brackets adjacent to siad power opening, and electrical conductor means, extending through said power opening and providing an electrical connection between said junction box and said motor.

22. The device of claim 21 in which said housing further defines an inwardly extending flange surrounding said power opening, and power opening cover means for covering said power opening.

23. The device of claim 21 in which said electrical junction box includes an electrical outlet receptacle and in which said electrical conductor means includes a mating electrical connector.

* * * * *